United States Patent [19]

Budzich

[11] 4,249,569

[45] Feb. 10, 1981

[54] LOAD RESPONSIVE FLUID CONTROL VALVE

[76] Inventor: Tadeusz Budzich, 80 Murwood Dr., Moreland Hills, Ohio 44022

[21] Appl. No.: 49,796

[22] Filed: Jun. 18, 1979

Related U.S. Application Data

[63] Continuation-in-part of Ser. No. 949,250, Oct. 6, 1978.

[51] Int. Cl.[3] ..... F15B 13/08

[52] U.S. Cl. ..... 137/596.2; 60/427; 91/436; 91/446; 137/596.13

[58] Field of Search ..... 60/427; 137/596.1, 596.13, 137/596.2, 625.68; 91/436, 446, 531

[56] References Cited

U.S. PATENT DOCUMENTS

| | | | |
|---|---|---|---|
| 3,807,447 | 4/1974 | Masuda | 137/596.13 |
| 3,998,134 | 12/1976 | Budzich | 137/596.1 X |
| 4,028,889 | 6/1977 | Budzich | 137/596.12 X |

*Primary Examiner*—Gerald A. Michalsky

[57] ABSTRACT

A direction flow control valve in a load responsive system equipped with a positive load compensator, which in the presence of negative load either blocks the pump flow to the motor above a certain predetermined level of the exhaust manifold pressure, or below that predetermined pressure level acts as a pressure reducing valve throttling sufficient fluid flow from the pump circuit to pressurize the exhaust manifold.

8 Claims, 1 Drawing Figure

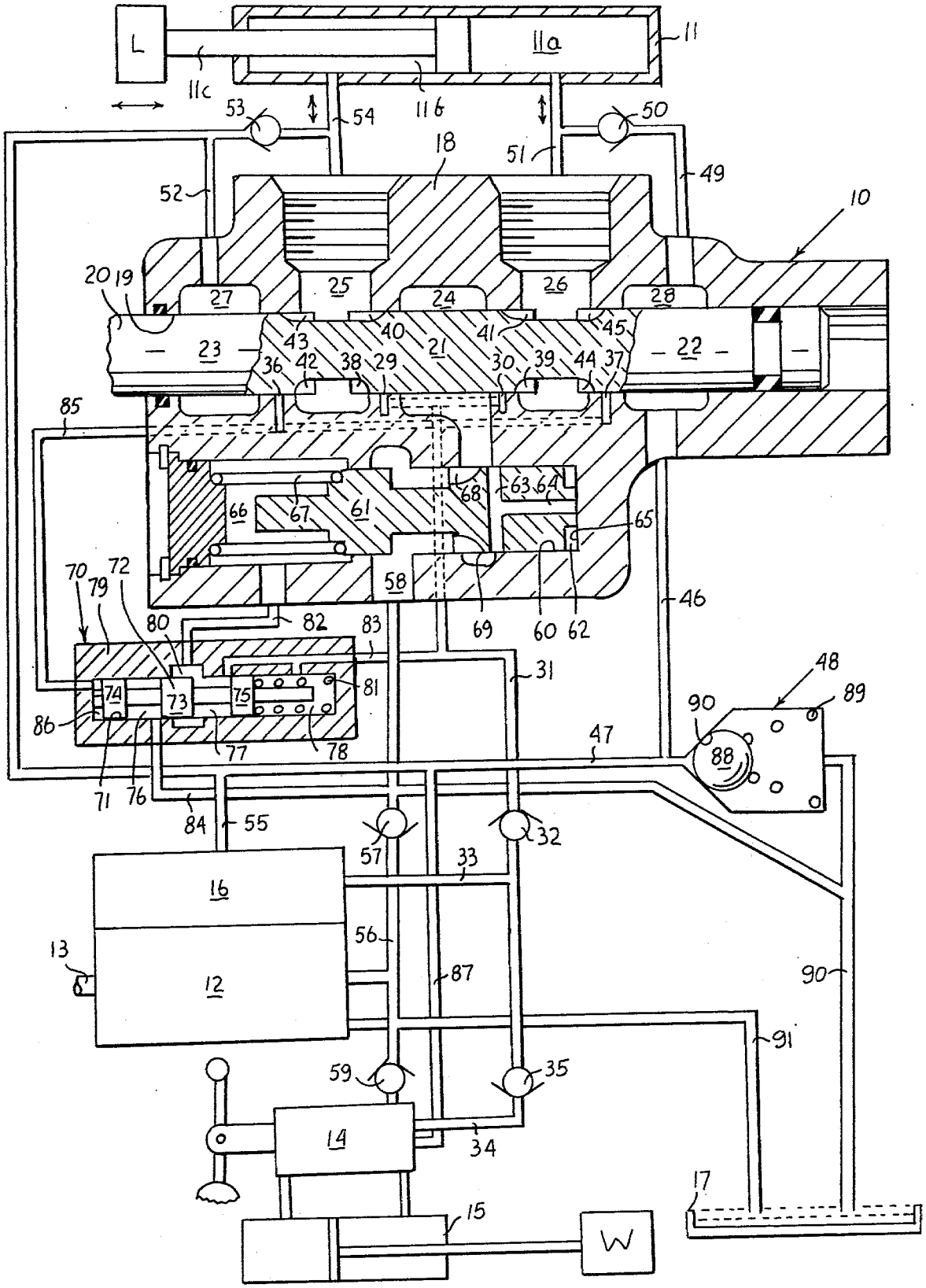
L
11a
11
11c
11b
53
54
50
18
51
49
52
10
20
19
27
25
24
26
28
23
43
40
21
41
45
22
36
42
38
29
30
39
44
37
85
66
67
61
68
63
64
65
70
79
72
58
69
60
62
46
80
82
83
31
48
89
90
74
73
75
81
86
77
78
47
88
71
76
84
55
57
32
33
16
56
13
12
87
90
91
59
35
14
34
17
15
W

LOAD RESPONSIVE FLUID CONTROL VALVE

This application is a continuation in part of application Ser. No. 949,250 filed Oct. 6, 1978 for "Load Responsive Fluid Control Valve."

BACKGROUND OF THE INVENTION

This invention relates generally to load responsive direction and flow control valves, equipped with positive load compensator, which while controlling a negative load interrupt pump flow to the motor, while the motor inlet is provided with fluid from the pressurized system exhaust.

In more particular aspects this invention relates to load responsive direction and flow control valves, which during control of negative load, while interrupting pump flow to the motor provide sufficient flow from pump circuit to the exhaust manifold circuit to maintain it pressurized under all conditions of operation.

In conventional pressure compensated load responsive valves the inlet flow requirement of the actuator, subjected to negative load, is supplied from the pump outlet flow. This common feature carries a number of serious disadvantages, since not only the pressurized fluid from the pump must be throttled down to a low pressure level, thus reducing the system efficiency, but also the capacity of the system pump to provide useful work is greatly reduced.

Those drawbacks can be overcome in part by provision of fluid control valves as disclosed in U.S. Pat. No. 3,804,447 issued to Masuda on Apr. 30, 1974. However, while those valves utilize actuator exhaust fluid for actuator inlet flow requirement when controlling negative loads, their principle of operation is based on series type circuit, in which excess fluid flow is successively diverted from one valve to the other and in which loads arranged in series determines the system pressure, instead of transmitting individual load pressure signal to the pump controls.

SUMMARY OF THE INVENTION

It is therefore a principal object of this invention to provide improved load responsive fluid direction and flow control valves for use in an essentially parallel circuit, which block system pump from motor inlet and supply it with system exhaust flow when controlling negative loads.

It is a further object of this invention to provide load responsive fluid direction and flow control valves with a pressurized exhaust manifold, the pressure of which, below a certain predetermined level, is maintained by pressure fluid diverted from the pump circuit.

It is a further object of this invention to provide load responsive fluid direction and flow control valves with an improved flow blocking device, positioned between the system pump and the load circuits, which responds during control of negative load, after the negative load pressure reaches a certain minimum predetermined level.

Briefly the foregoing and other additional objects and advantages of this invention are accomplished by providing a novel load responsive fluid control system, the exhaust circuit of which is pressurized, the exhaust flow being used to provide inlet flow requirements of motors controlling negative loads and if necessary supplemented from pump discharge circuit. When controlling a negative load the flow from the pump to the system load is interrupted, when the negative load pressure reaches a certain minimum predetermined level.

Additional objects of this invention will become apparent when referring to the preferred embodiment of the invention as shown in the accompanying drawing and described in the following detailed description.

DESCRIPTION OF THE DRAWING

The drawing shows a longitudinal sectional view of an embodiment of a flow control valve having a positive load control responsive to actuator upstream pressure differential and a sequencing valve with lines, system flow control, system pump, second load responsive valve, exhaust relief valve and system reservoir shown diagramatically.

DESCRIPTION OF THE PREFERRED EMBOIDMENT

Referring now to the drawing an embodiment of a flow control valve, generally designated as 10, is shown interposed between diagramatically shown fluid motor 11, having chambers 11*a* and 11*b* and piston rod 11*c*, connected to a load L and a pump 12 of a fixed displacement or variable displacement type driven through a shaft 13 by a prime mover not shown.

Similarly, a flow control valve 14, identical to flow control valve 10, is interposed between a diagramatically shown fluid motor 15 driving a load W and the pump 12. Fluid flow from the pump 12 to fluid control valves 10 and 14 is regulated by a pump flow control 16. If pump 12 is of a fixed displacement type, pump flow control 16 is a differential pressure relief valve, which, in a well known manner, by bypassing fluid from the pump 12 to a reservoir 17, maintains discharge pressure of pump 12 at a level, higher by a constant pressure differential, than load pressure developed in the fluid motor 11 or 15. If pump 12 is of a variable displacement type pump flow control 16 is a differential pressure compensator, well known in the art, which by changing displacement of pump 12 maintains discharge pressure of pump 12 at a level, higher by a constant pressure differential, than load pressure developed in fluid motor 11 or 15.

The flow control valve 10 is of a fourway type and has a housing 18 provided with a bore 19 axially guiding a valve spool 20. The valve spool 20 is equipped with lands 21, 22 and 23, which in neutral position of the valve spool 20, as shown in the drawing, isolate a fluid supply chamber 24, load chambers 25 and 26 and outlet chambers 27 and 28.

Positive load sensing ports 29 and 30, located between load chambers 25 and 26 and the supply chamber 24 and blocked in neutral position of valve spool 20 by land 21, are connected through signal passage 31, a check valve 32 and signal line 33 to pump flow control 16. In a similar positive load sensing ports of flow control valve 14 are connected through line 34, a check valve 35 and signal line 33 to the pump flow control 16. Negative load sensing port 36 is located between load chamber 25 and outlet chamber 27. Similarly, negative load sensing port 37 is located between load chamber 26 and outlet chamber 28.

The land 21 of the valve spool 20 is equipped with signal slots 38 and 39, located in plane of positive load sensing ports 29 and 30 and metering slots 40 and 41, which, in a well known manner, can be circumferentially spaced in respect to each other and in respect to signal slots 38 and 39. The land 23 is equipped with signal slot 42, located in plane of negative load sensing port 36 and circumferentially spaced metering slot 43. The land 22 is equipped with signal slot 44, located in plane of negative load sensing port 37 and circumferentially spaced metering slot 45. Signal slots 38, 39, 42 and 44, in a well known manner, can be substituted by end surfaces of lands 21, 22 and 23. A suitable device is provided to prevent relative rotation of the valve spool 20 in respect to bore 19.

The outlet chamber 28 is connected through line 46 and exhaust line 47 to the exhaust relief valve, generally designated as 48, while being also connected through line 49, a check valve 50 and line 51 with the load chamber 26. The outlet chamber 27 is connected through line 52 with exhaust line 47, while being also connected through the check valve 53 and line 54 with the load chamber 25. Exhaust line 47 is also connected through line 55 with the pump flow control 16.

The pump 12, through its discharge line 56 and a load check 57 is connected to a fluid inlet chamber 58. Similarly, discharge line 56 is connected through a load check 59 with the inlet chamber of the fluid control valve 14. Control bore 60 connects the fluid inlet chamber 58 with the fluid supply chamber 24. The control spool 61, axially slidable in control bore 60 projects on one end into space 62, connected to the fluid supply chamber 24 by passages 63 and 64 and abuts against surface 65. The control spool 61 on the other end projects into control space 66 and is biased by a control spring 67. The control spool 61 is provided with slots 68 terminating in throttling edges 69, positioned between the inlet chamber 58 and the supply chamber 24. The control spool 61 is biased by the control spring 67 towards position, in which slots 68 connect the fluid supply chamber 24 with the fluid inlet chamber 58.

The sequencing valve, generally designated at 70, is provided with bore 71, slidably guiding a spool 72, which with lands 73, 74 and 75 defines annular spaces 76, 77 and space 78. The sequencing valve housing 79 is provided with annular space 80. The spool 72 is biased, towards position as shown in the drawing, by a spring 81. Annular space 80 is connected through passage 82 with control space 66 and with the spool 72 in the position as shown in the drawing, it is also connected through passage 83 with signal passage 31. Annular space 76 through line 84 communicates with down stream of the exhaust relief valve 48 and therefore with system reservoir 17. The negative load sensing ports 36 and 37 are connected by line 85 with space 86, directly communicating with land 74 of the spool 72.

The exhaust relief valve, generally designated as 48, is interposed between combined exhaust circuits of flow control valves 10 and 14, including bypass circuit of the pump 12. The exhaust circuit of the flow control valve 14 is connected by line 87 with the exhaust line 47, forming a common exhaust manifold. The exhaust relief valve 48 is provided with a throttling member 88, biased by a spring 89 towards engagement with seat 90.

If the pump 12 is of a fixed displacement type excess pump flow from the differential pressure relief valve or the pump flow control 16 is delivered through line 55 to exhaust line 47 and therefore to the total pressurized exhaust circuit of a flow control valves 10 and 14.

The sequencing of the lands and slots of the valve spool 20 preferably is such that when displaced in either direction from its neutral position, as shown in the drawing, one of the load chambers 25 or 26 is first connected by signal slot 38 or 39 to the positive load sensing port 29 or 30, while the other load chamber is connected by signal slot 42 or 44 to the negative load sensing port 36 or 37, while the load chambers 25 and 26 are still isolated from the supply chamber 24 and outlet chambers 27 and 28. Further displacement of the valve spool 20 from its neutral position connects load chamber 25 or 26 to the supply chamber 24 through metering slots 40 or 41, while connecting the other load chamber through metering slot 43 or 45 with one of the outlet chambers 27 or 28.

Referring now to the drawing, with pump 12 of a fixed displacement type started up the pump flow control 16 will bypass through line 55, exhaust line 47, the exhaust relief valve 48 and line 90 all of the pump flow to the system reservoir 17 at minimum pressure level, equivalent to preload in the spring 89, while automatically maintaining pressure in discharge line 56 at a constant pressure, higher by a constant pressure differential, than pressure in signal line 31 or pressure in exhaust line 47. An equal amount of suction fluid will be taken from the reservoir 17 and transmitted through line 91 to the inlet port of the pump 12. Under those conditions all of the pump flow is diverted by the pump flow control 16 to the low pressure exhaust circuit, as previously described, without being used by flow control valves 10 and 14. The pump bypass pressure transmitted through passages 63 and 64 to space 62, reacts on the cross-sectional area of control spool 61 and against the bias of control spring 67 moves the control spool 61 from right to left, closing with throttling edges 69 the passage between the inlet chamber 58 and the supply chamber 24.

With pump 12 of a variable displacement type, under working conditions, minimum flow to the system exhaust manifold, composed of line 87, exhaust line 47 and exhaust pressure relief valve 48, may have to be diverted from the pump 12, to maintain the system exhaust manifold pressurized.. A pressure reducing type regulator can be used, which upon system exhaust manifold pressure dropping below the setting of the exhaust pressure relief valve 48, will throttle some of the pump discharge flow and supply it to the exhaust manifold, to maintain it at a certain preselected minimum pressure level.

Assume that the load chamber 25 is subjected to a positive load pressure. The initial displacement of valve spool 20 to the right will connect the load chamber 25 through signal slot 38 with positive load sensing port 29, while lands 21, 22 and 23 still isolate the supply chambers 24, load chambers 25 and 26 and outlet chambers 27 and 28. As previously described positive load signal, transmitted from positive load sensing port 29, through signal passage 31, check valve system and signal line 33 to the pump flow control 16 will increase the pressure in discharge line 56 to a level, which is higher by a constant pressure differential than the load pressure signal. The load pressure transmitted through passage 83, annular space 77, annular space 80 and passage 82 to control space 66, will move the positive load control spool 61 to the right, opening through slots 68 communication between the inlet chamber 58 and the supply chamber 24. Communication will be maintained between the supply chamber 24 and the inlet chamber 58, as long as the pump flow control 16 maintains a constant pressure differential between the pump discharge pressure and the positive load pressure.

Further displacement of valve spool 20 to the right will connect the load chamber 25, through metering slot 40, with the supply chamber 24 and will also connect through metering slot 45 the load chamber 26 with the outlet chamber 28. In a manner as previously described, the pump flow control 16 will maintain a constant pressure differential across orifice, created by displacement of metering slot 40, the flow into the load chamber 25 being proportional to the area of the orifice and therefore displacement of the valve spool 20 from its neutral position and independent of the magnitude of the load L.

Assume that while controlling positive load L through the flow control valve 10, a higher positive load W is actuated through the flow control valve 14. Higher load pressure signal from the flow control valve 14 will be transmitted through the check valve system to the pump flow control 16, which will now maintain system pressure, higher by a constant pressure differential, than pressure generated by positive load W. In a manner as previously described, the pressure drop through metering slot 40 will increase, therefore increasing the pressure differential between space 62 and control space 66. The positive load control spool 61 will move into its modulating position, throttling with throttling edges 69 the fluid flowing from the inlet chamber 58 to the supply chamber 24, to maintain a constant pressure differential between the supply chamber 24 and the load chamber 25, thus controlling fluid flow through metering slot 40. While this throttling control action takes place, in a well known manner, the load chamber 26 is subjected to low exhaust pressure, which through negative load sensing port 37 and line 85 will be transmitted to space 86. Therefore during control of positive load the spool 72, of the sequencing valve 70, is maintained in the position as shown in the drawing by the positive load pressure and the preload in the spring 81, connecting positive load pressure sensing port 29 with control space 66.

Assume that the load chamber 26 is subjected to a negative load L and that the valve spool 20 is displaced from its neutral position to the right while, as previously described, the positive load control spool 61 is maintained by the pump standby pressure in a position blocking communication between the inlet chamber 58 and the supply chamber 24. Initial displacement of valve spool 20 will connect through signal slot 38 the load chamber 25 with the positive load sensing port 29, passage 83 and space 78. Since the load chamber 25 is subjected to low pressure neither the pump flow control 16 nor the positive load control spool 61 will react to it. Simultaneously signal slot 44 will be connected to the negative load sensing port 37, connecting the load chamber 26, subjected to negative load pressure through line 85 with space 86 of the sequencing valve 70. The negative load pressure, reacting on the cross-sectional area of the spool 72 will move it all the way from left to right, against biasing force of the spring 81, closing, through displacement of land 73, communication between control space 66 and positive load sensing port 29 and opening communcation between control space 66 and line 84, connected through line 90 with system reservoir 17. Therefore as long as the negative load pressure in the load chamber 26 is sufficiently high to overcome the preload of spring 81, the control space 66, during control of negative load, will be always directly connected to the system reservoir 17. Under those conditions the control spool 61 will move into its modulating position, throttling the pressure fluid from the inlet chamber 58 to maintain supply chamber 24 and space 62 at a constant pressure level, equivalent to preload in the control spring 67. Therefore with control space 66 connected to reservoir pressure, the control spool 61 will act as a constant pressure reducing valve, always maintaining the load chamber 24 at a low constant pressure level, equivalent to preload in the control spring 67.

Further displacement of valve spool 20 to the right will connect through metering slot 45 the load chamber 26 with the outlet chamber 28, while also connecting through metering slot 40 the load chamber 25 with the supply chamber 24. In a well known manner the orifice created by displacement of metering slot 45 will throttle the negative load pressure and establish a flow from the chamber **11*a* and the load chamber 26 to the outlet chamber 20, line 46 and exhaust line 47. If the pressure setting of the exhaust relief valve 48 is lower than the constant pressure in the supply chamber 24, maintained by the control spool 61, fluid flow will take place between the supply chamber 24 and the load chamber 25 through metering slot 40. If resistance to flow is such that the pressure in the load chamber 25 would drop below pressure setting of exhaust relief valve 48, the check valve 53 will open and additional flow will be supplied to the load chamber 25 from the exhaust line 47. The exhaust relief valve 48 will open and pass to the system reservoir the difference between the volume of fluid supplied from the chamber 11*a* and supplied from exhaust line 47 through check valve 53 to the chamber 11*b*, a certain percentage of the flow delivered to the chamber 11*b* being supplied from the supply chamber 24** and therefore from the pump discharge circuit.

Assume that while controlling negative load, under conditions as described above, the pressure of the exhaust relief valve 48 would be selected higher than the constant pressure, regulated by the control spool 61 in the supply chamber 24. Therefore this higher pressure, transmitted through exhaust line 47, the check valve 53 and line 54 will exist in the load chamber 25. Since the load chamber 25 is connected through metering slot 40 with the supply chamber 24, the pressure in the supply chamber 24 will increase above the constant controlled pressure level, normally maintained by control spool 61. This higher pressure in the supply chamber 24 and space 62, reacting on the cross-sectional area of the control spool 61, will move it all the way from right to left, cutting off communication through throttling edges 69 between the inlet chamber 58 and the supply chamber 24. Under those conditions the total inlet flow requirement of the chamber **11*b* will be supplied from the chamber 11*a*, the load chamber 26, the outlet chamber 28 and exhaust line 47, the exhaust relief valve 48 passing to system reservoir 17 the difference between outlet and inlet flow of the motor 11, which is equal to the displacement within the volume of the piston rod 11*c***.

Assume now that the load chamber 25 is subjected to negative load, that the valve spool 20 was displaced from right to left and that the pressure setting of the exhaust relief valve 48 is higher than the constant pressure level, maintained by the control spool 61 in the supply chamber 24. The sequencing valve 70, in a manner as previously described, will maintain direct communication between control space 66 and the system reservoir. The orifice, created by displacement of the metering slot 43, will control the flow of fluid, subjected to negative load pressure, from the load chamber 25 to the outlet chamber 27. During control of negative load the fluid displacement from chamber 11*b* is less, by the displacement of the piston rod 11*c*, than the inlet flow requirement into chamber 11*a* of motor 11. Under those conditions the pressure in the exhaust circuit and therefore the pressure in the exhaust line 47 will drop to a level, at which the exhaust relief valve 48 will close completely. All the flow from the chamber 11*b* through the outlet chamber 27, line 52, exhaust line 47, line 46, the outlet chamber 28, line 49, the check valve 50 and line 51 will be transferred to the chamber 11*a*. This flow will be supplemented through metering slot 41 from the supply chamber 24, which is maintained at a constant pressure level by the control spool 61. Therefore the control spool 61, acting as a constant pressure reducing valve, will throttle from the pump discharge circuit enough fluid flow, to supply into the load chamber 26 and the chamber 11*a* a volume of fluid, equal to the displacement of the piston rod 11*c*, maintaining the exhaust circuit pressurized at a pressure level, lower than the constant pressure level maintained in the supply chamber 24. The difference in pressures between the supply chamber 24 and the exhaust circuit will be established by the throttling action of metering slot 41. Therefore during control of negative load, from the piston rod end of the fluid motor, the control spool 61, acting as a constant pressure reducing valve, diverts sufficient amount of fluid flow from the pump discharge circuit to make up the difference in displacement of fluid between chambers 11*b* and 11*a*, still maintaining the exhaust circuit pressurized at an intermediate pressure level. Therefore the control spool 61 performs a dual function and that is of either a constant pressure reducing valve or a blocking valve, depending on the direction of the negative load and the construction of the fluid motor.

During control of negative load preload of the spring 81 dictates the minimum level of the negative load pressure, at which the sequencing valve 70 will be actuated and the control spool 61 will become a constant pressure reducing valve. This minimum negative load pressure level is so selected that the control of negative load can be performed with pump circuit being deactivated. At negative load pressures lower than this minimum selected level the energy from the pump will be supplied in order to be able to control the negative load at this low negative load pressure level.

Although the preferred embodiment of this invention has been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A valve assembly supplied with pressure fluid by a pump, said valve assembly comprising a housing having a fluid inlet chamber, a fluid supply chamber, first and second load chambers, positive load pressure sensing means, negative load pressure sensing means, and exhaust means, first valve means for selectively interconnecting said fluid load chambers with said positive load pressure sensing means and said negative load pressure sensing means, said supply chamber and said exhaust means, first variable metering orifice means responsive to movement of said first valve means between said fluid supply chamber and said load chambers, second variable metering orifice means responsive to movement of said first valve means between said load chambers and said exhaust means, second valve means having inlet fluid throttling means between said fluid inlet chamber and said fluid supply chamber, said second valve means including a first force generating means having means responsive to fluid pressure in said positive load pressure sensing means, and a second force generating means having means responsive to pressure in said supply chamber, first spring biasing means opposing said second force generating means and third valve means having means selectively operable to connect said first force generating means with said reservoir means said third valve means having means responsive to pressure in said negative load pressure sensing means, and second spring biasing means opposing said means responsive to pressure in said negative load pressure sensing means.

2. A valve assembly as set forth in claim 1 wherein said third valve means has means responsive to pressure differential between said negative load pressure sensing means and said positive load pressure sensing means.

3. A valve assembly as set forth in claim 1 wherein exhaust relief valve means is positioned in said exhaust means.

4. A valve assembly as set forth in claim 3 wherein check valve means are operable to interconnect for one way flow said fluid load chambers and said fluid exhaust means upstream of said exhaust relief valve means.

5. A valve assembly as set forth in claim 1 wherein said second valve means has isolating means operable to selectively isolate said fluid supply chamber from said fluid inlet chamber.

6. A valve assembly as set forth in claim 5 wherein said isolating means has means responsive to pressure in said supply chamber.

7. A valve assembly as set forth in claim 5 wherein said isolating means has means responsive to pressure differential between pressure in said supply chamber and pressure in said exhaust means.

8. A valve assembly as set forth in claim 1 wherein said third valve means has means operable to disconnect said first force generating means from said positive load pressure sensing means while said means selectively operable to connect said first force generating means with said reservoir means is activated.

* * * * *